US011427417B2

(12) United States Patent
Shiokawa

(10) Patent No.: US 11,427,417 B2
(45) Date of Patent: Aug. 30, 2022

(54) IMAGE FORMING DEVICE

(71) Applicant: Konica Minolta, Inc., Tokyo (JP)

(72) Inventor: Tsuyoshi Shiokawa, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/380,642

(22) Filed: Jul. 20, 2021

(65) Prior Publication Data

US 2022/0041384 A1 Feb. 10, 2022

(30) Foreign Application Priority Data

Aug. 5, 2020 (JP) ..... JP2020-133002

(51) Int. Cl.

| | |
|---|---|
| ***G03G 21/16*** | (2006.01) |
| ***B65H 1/08*** | (2006.01) |
| ***B65H 1/26*** | (2006.01) |
| ***G03G 15/00*** | (2006.01) |

(52) U.S. Cl.

CPC ..... *B65H 1/08* (2013.01); *B65H 1/266* (2013.01); *G03G 15/6529* (2013.01); *G03G 15/6552* (2013.01)

(58) Field of Classification Search

CPC ..... B65H 2511/528; B65H 1/08; B65H 1/26; B65H 1/266; B65H 2601/11; B65H 2601/255; G03G 21/16

USPC ..... 399/110, 124

See application file for complete search history.

(56) References Cited

U.S. PATENT DOCUMENTS

| | | | | |
|---|---|---|---|---|
| 5,517,281 | A * | 5/1996 | Miyashiro | G03G 21/1638 399/124 |
| 5,787,326 | A * | 7/1998 | Ogawa | G03G 21/1633 399/302 |
| 6,125,251 | A * | 9/2000 | Shiraishi | G03G 21/1638 399/110 |
| 7,024,132 | B2 * | 4/2006 | Nakaoka | G03G 15/234 399/110 |
| 7,210,680 | B2 * | 5/2007 | Yoneda | B65H 5/062 271/274 |
| 10,167,166 | B2 * | 1/2019 | Kakitani | B65H 7/06 |
| 2007/0059037 | A1 * | 3/2007 | Hirai | G03G 21/1638 399/119 |
| 2018/0356760 | A1 * | 12/2018 | Suto | B65H 5/062 |

* cited by examiner

FOREIGN PATENT DOCUMENTS

| | | | | |
|---|---|---|---|---|
| CN | 204925619 U | * | 12/2015 | B41J 29/13 |
| JP | 2002356245 A | | 12/2002 | |
| JP | 2003054778 A | | 2/2003 | |

*Primary Examiner* — Leslie A Nicholson, III

(74) *Attorney, Agent, or Firm* — Osha Bergman Watanabe & Burton LLP

(57) ABSTRACT

An image forming device includes a device body; a conveyance table that is inserted into and pulled out of the device body and that forms a conveyance path for a sheet; a sheet mount tray; a paper feeder that feeds the sheet from the sheet mount tray to the conveyance path; and a movable support that movably supports the paper feeder on the conveyance table in a state where the conveyance table is pulled out of the device body. The paper feeder covers a predetermined part of the conveyance path in a state where the paper feeder disposed on the conveyance table is inserted into the device body, the sheet mount tray is disposed in the device body and separates from the paper feeder when the conveyance table is pulled out of the device body, and the paper feeder moves away from the predetermined part.

13 Claims, 7 Drawing Sheets

IMAGE FORMING DEVICE

CROSS-REFERENCE TO RELATED APPLICATIONS

The entire disclosure of Japanese patent application No. 2020-133002, filed on Aug. 5, 2020, is incorporated herein by reference.

BACKGROUND

1. Technical Field

The present invention relates to an image forming device.

2. Description of the Related Art

Conventionally, image forming devices that form images on paper have been known. JP2003-54778A and JP2002-356245A disclose such image forming devices. A conveyance table that forms a paper conveyance path is inserted into and pulled out of a device body.

In some devices, a manual paper feeder (handling roller and manual paper feed roller) is integrated with the conveyance table. When the conveyance table is inserted and pulled out, the manual paper feeder is also inserted and pulled out.

When paper jam occurs in the conveyance path of the conveyance table, a user or the like pulls out the conveyance table, opens and closes one side (such as an upper part) of a guide plate that guides sheets, and removes a sheet.

However, since the paper feeder (paper feed mechanism) provided on the conveyance table is integrated with the conveyance table as described above, a space for opening the guide plate for the conveyance path is narrow. The opening is not enough. Coping with a paper jam is sometimes difficult.

In recent years, there has been a demand for miniaturization of devices. However, if a space is made between the paper feeder and the conveyance path to increase an opening amount of the conveyance path for sheets, the device gets larger.

SUMMARY

One or more embodiments of the present invention facilitate coping with a jam in an image forming device by securing a space for removing jam paper when the device is stopped for coping with the jam without increasing a size of the device during operation.

According to one or more embodiments of the present invention, an image forming device includes:

a device body;

a conveyance table which is inserted into and pulled out of the device body and which forms a conveyance path for a sheet;

a sheet mount portion on which the sheet is placed;

a paper feeder which is provided on the conveyance table and which feeds the sheet from the sheet mount portion to the conveyance path; and a movable support which movably supports the paper feeder on the conveyance table in a state where the conveyance table is pulled out of the device body, wherein the paper feeder covers a predetermined conveyance path part of the conveyance path in a state where the paper feeder together with the conveyance table are inserted into the device body, the sheet mount portion is provided in the device body, and separates from the paper feeder when the conveyance table is pulled out of the device body, and the movable support allows the paper feeder to move away from the conveyance path part.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, embodiments of the present invention will be described in detail with reference to the drawings. However, the scope of the invention is not limited to the disclosed embodiments.

Overview of Image Forming Device

Figure 1:
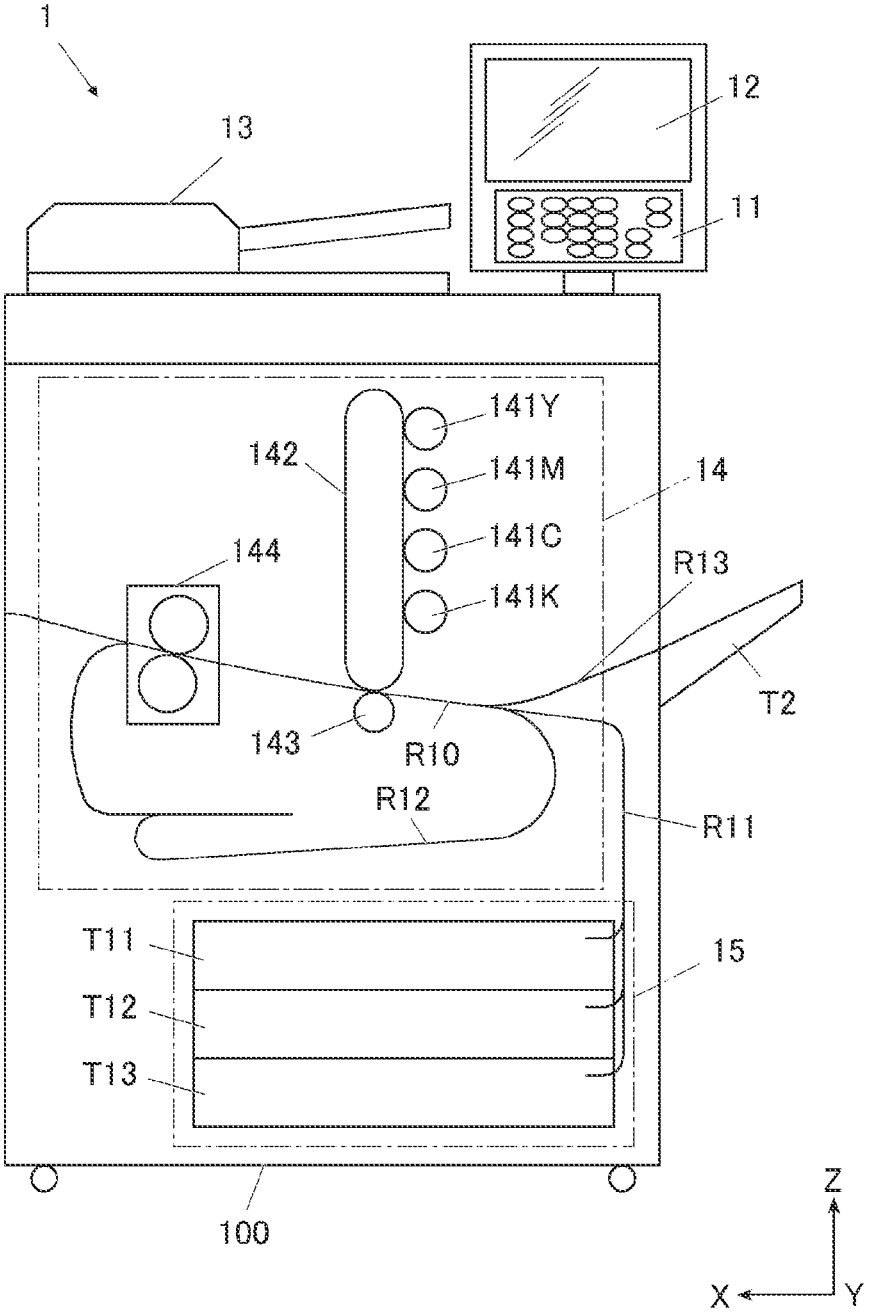
FIG. 1 shows schematic configuration of an image forming device according to one or more embodiments.

An image forming device 1 according to one or more embodiments in FIG. 1 forms a color image in an electrophotographic method based on image data obtained by reading an image in a document or image data received from an external device. As shown in FIG. 1, the image forming device 1 includes an operation interface 11, a display 12, a document reader 13, an image former 14, and a paper feeder 15. The image forming device 1 further includes an image formation controller 16, memory, a controller interface, and an image processor.

The operation interface 11 includes a touch panel that covers a display screen of the display 12, as well as various operation buttons such as number buttons and a start button. The operation interface 11 outputs operation signals based on operation of a user to the image formation controller.

The display 12 is constituted by an LCD (liquid crystal display). The display 12 displays various screens according to commands of display signals input from the image formation controller.

The document reader 13 includes an ADF (automatic document feeder) and a scanner. The document reader 13 outputs image data obtained by reading an image in a document to the image formation controller.

The image former 14 forms an image on a sheet supplied by the paper feeder 15 based on image data processed by the image processor 19.

The image former 14 includes photosensitive drums 141Y, 141M, 141C, 141K corresponding to colors of yellow (Y), magenta (M), cyan (C), and black (K), an intermediate transfer belt 142, a secondary transfer roller 143, and a fixing unit 144.

The photosensitive drum 141Y is uniformly charged. Then, the photosensitive drum 141Y is scanned and exposed by a laser beam based on yellow image data. Thereby an electrostatic latent image is formed. A yellow toner is put on the electrostatic latent image on the photosensitive drum 141Y. Development is performed.

The photosensitive drums 141M, 141C, 141K are also treated like the photosensitive drum 141Y, except that colors are different. Explanation is omitted.

Toner images of colors formed on the photosensitive drums 141Y, 141M, 141C, 141K are transferred onto the rotating intermediate transfer belt 142 one by one (primary transfer). Thus, a color toner image in which four color toner images are piled is formed on the intermediate transfer belt 142.

The secondary transfer roller 143 transfers the color toner image on the intermediate transfer belt 142 onto a sheet at once (secondary transfer).

The fixing unit 144 includes a heat roller that heats a sheet on which a color toner image is transferred, and a pressure roller that presses the paper. The fixing unit 144 fixes the color toner image on the sheet by heating and pressing.

The paper feeder 15 includes paper feed trays T11-T13, and supplies sheets to the image former 14. Each of the paper feed trays T11-T13 stores paper of a type and size predetermined for the paper feed tray.

The image formation controller includes a CPU, ROM, and memory.

The CPU reads various processing programs stored in the ROM. The CPU comprehensively controls operation of parts according to the program.

The ROM is constituted by non-volatile semiconductor memory or the like. The ROM stores various processing programs as well as parameters and files necessary for executing the programs.

The memory is constituted by DRAM (dynamic random access memory) or the like. The memory temporarily stores various data such as programs and image data for image processing of various kinds.

The memory is non-volatile memory, such as an HDD (hard disk drive) or semiconductor memory, which stores programs and various data such as image data. The memory stores data such as program data and various setting data. The image formation controller can read and write the data.

The controller interface receives image data input from an external device.

The image processor performs necessary image processing on:

image data stored in the memory;

image data obtained by reading an image in a document with the document reader 13; and image data input from an external device.

After the image processing, the image processor transmits image data to the image former 14. Image processing includes gradation processing, halftone processing, and color conversion processing. The gradation processing converts gradation values of pixels in image data into revised gradation values so that a density characteristic of an image formed on a sheet meets a target density characteristic. The halftone processing is error diffusion processing, screen processing in an ordered dither method, or the like. The color conversion processing converts gradation values in RGB into gradation values in CMYK.

Details of Conveyance Table

Next, a conveyance table and a mechanism related thereto will be described.

As shown in FIG. 1, a conveyance path R11 from the paper feeder 15, a reverse conveyance path R12, and a manual conveyance path R13 from a manual feed tray T2 merge with a conveyance path R10 to a transfer nip. The transfer nip is a contact point between the intermediate transfer belt 142 and the secondary transfer roller 143.

The conveyance table 20 shown in FIGS. 2 to 10 can be inserted into and pulled out of a device body 100. The conveyance table 20 forms the conveyance path R10, etc. for sheets. The paper feed trays T11-T13 and a manual feed tray T2 are sheet mount portions where sheets are put or placed.

Figure 4:
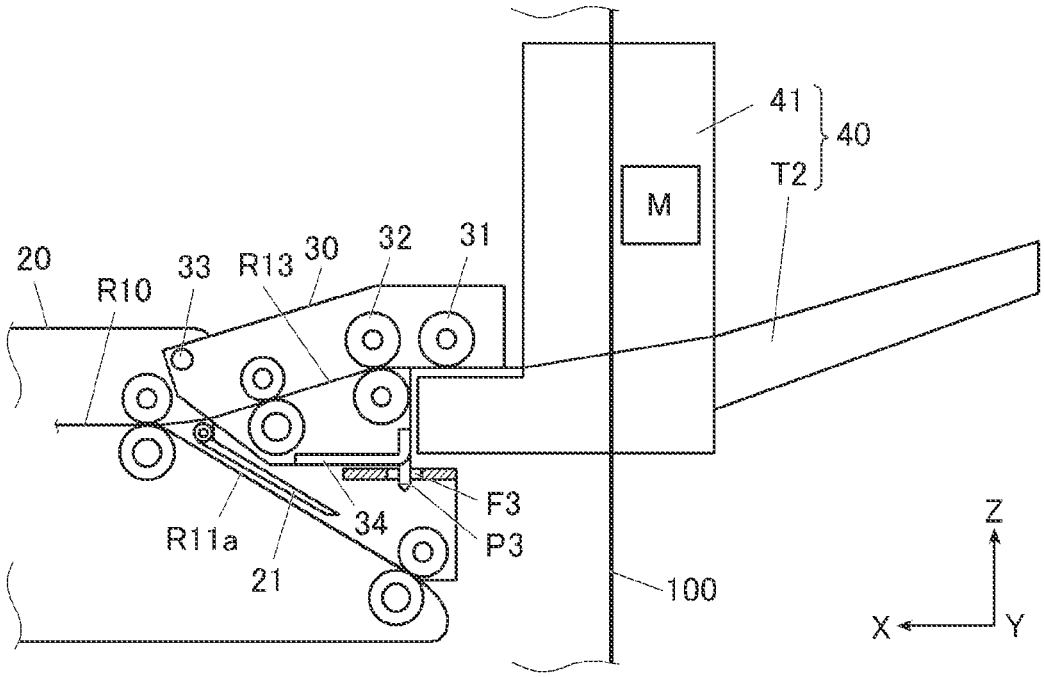
FIG. 4 is a vertical cross-sectional view between a manual feed tray and the conveyance table according to one or more embodiments of the present invention.

As shown in FIG. 4 and the like, a manual paper feeder 30 includes conveyance rollers such as a manual paper feed roller 31 and handling rollers 32, and forms the manual conveyance path R13. The manual paper feeder 30 feeds sheets from the manual feed tray T2 to the conveyance path R10 formed by the conveyance table 20.

Figure 2:
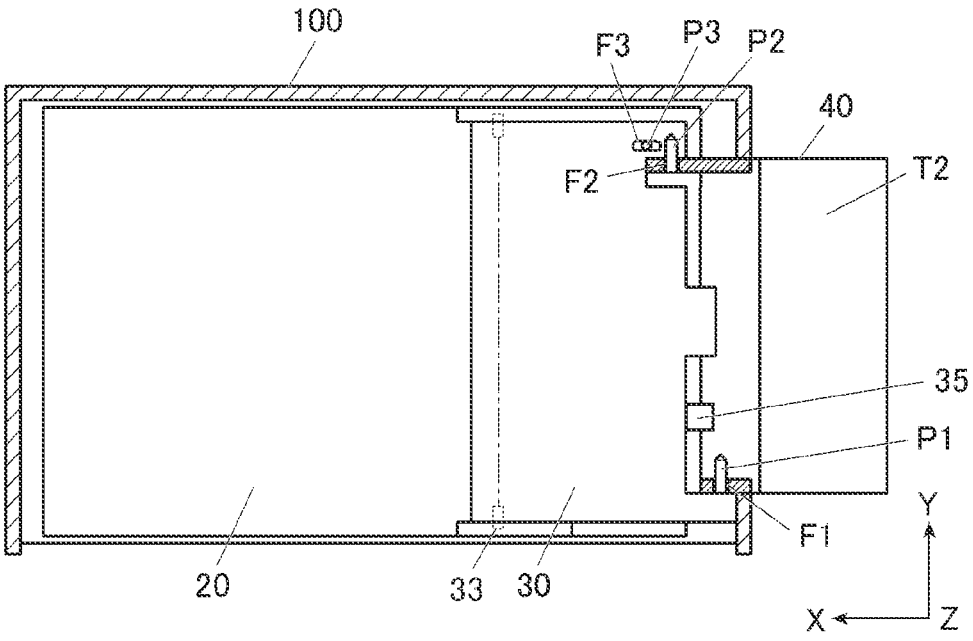
FIG. 2 is a horizontal cross-sectional view of the image forming device according to one or more embodiments of the present invention, showing a state in which a conveyance table is inserted.
Figure 3:
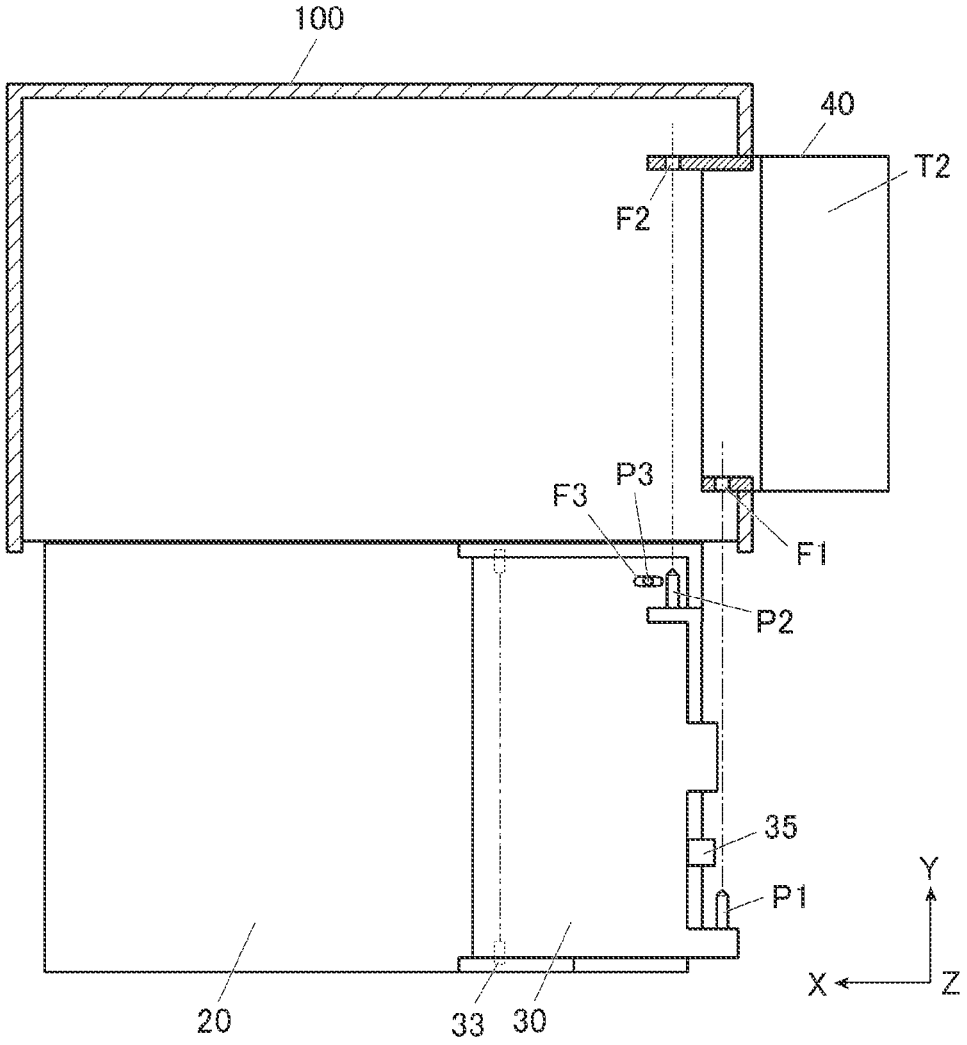
FIG. 3 is a horizontal cross-sectional view of the image forming device according to one or more embodiments of the present invention, showing a state in which the conveyance table is pulled out.

As shown in FIGS. 2 to 5 and the like, the manual paper feeder 30 is provided or disposed on the conveyance table 20. The image forming device 1 includes a movable support 33. The movable support 33 movably supports the manual paper feeder 30 on the conveyance table 20 in a state where the conveyance table 20 is pulled out of the device body (FIG. 3).

The movable support 33 of one or more embodiments is a hinge mechanism that allows turning movement of the manual paper feeder 30.

Figure 5:
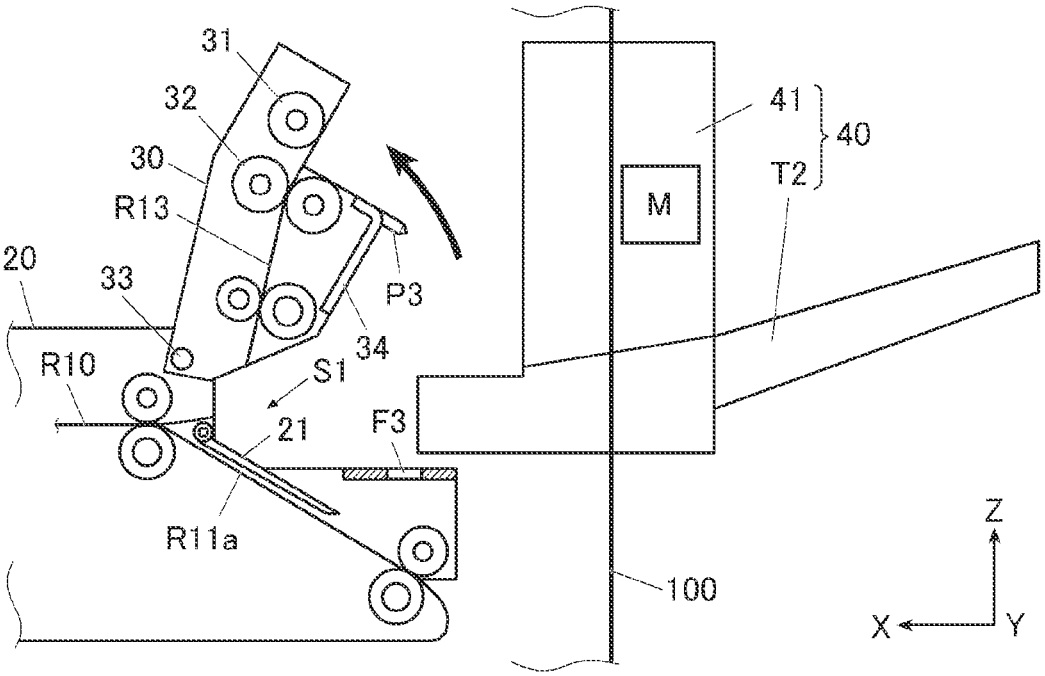
FIG. 5 shows a state in which a manual paper feeder is turned to be raised from the state of FIG. 4.

As shown in FIG. 5, the manual paper feeder 30 turns around the Y axis. The manual paper feeder 30 can turn in the state where the conveyance table 20 is pulled out of the device body (FIG. 3).

In a state where the manual paper feeder 30 is lowered as shown in FIG. 4, the manual paper feeder 30 together with the conveyance table 20 can be inserted into the device body 100. As shown in FIG. 2, in a state where the manual paper feeder 30 is actually inserted, the manual paper feeder 30 is fixed at a predetermined position. Further, there is no space in the device body 100. Therefore, turning movement as shown in FIG. 5 cannot be performed.

A manual feed unit 40 integrally includes the manual feed tray T2 and an elevation mechanism 41. The elevation mechanism 41 includes a motor M and the like for elevating and lowering the manual feed tray T2. The manual feed unit 40 is fixed to the right side of the device body 100.

In the state where the manual paper feeder 30 is inserted as shown in FIG. 2, the manual paper feeder 30 is connected to the manual feed unit 40 at a predetermined position. The manual feed unit 40 is provided in the device body 100. When the conveyance table 20 is pulled out of the device body 100, the manual feed unit 40 is separated from the manual paper feeder 30.

In a state where the manual paper feeder 30 together with the conveyance table 20 can be inserted into the device body 100 as shown in FIG. 4, the manual paper feeder 30 covers a predetermined conveyance path part R11*a* of a conveyance path formed by the conveyance table 20. In one or more embodiments, the conveyance path part R11*a* is a part of the conveyance path R11 from the paper feeder 15.

The movable support 33 allows the manual paper feeder 30 to move away from the conveyance path part R11*a* as shown in FIG. 5.

Therefore, an operator pulls out the conveyance table 20 and raises the manual paper feeder 30 as shown in FIG. 5 so that the manual paper feeder 30 moves away from the conveyance path part R11*a*. It facilitates removal of jam paper staying in the conveyance path part R11*a*.

Figure 6:
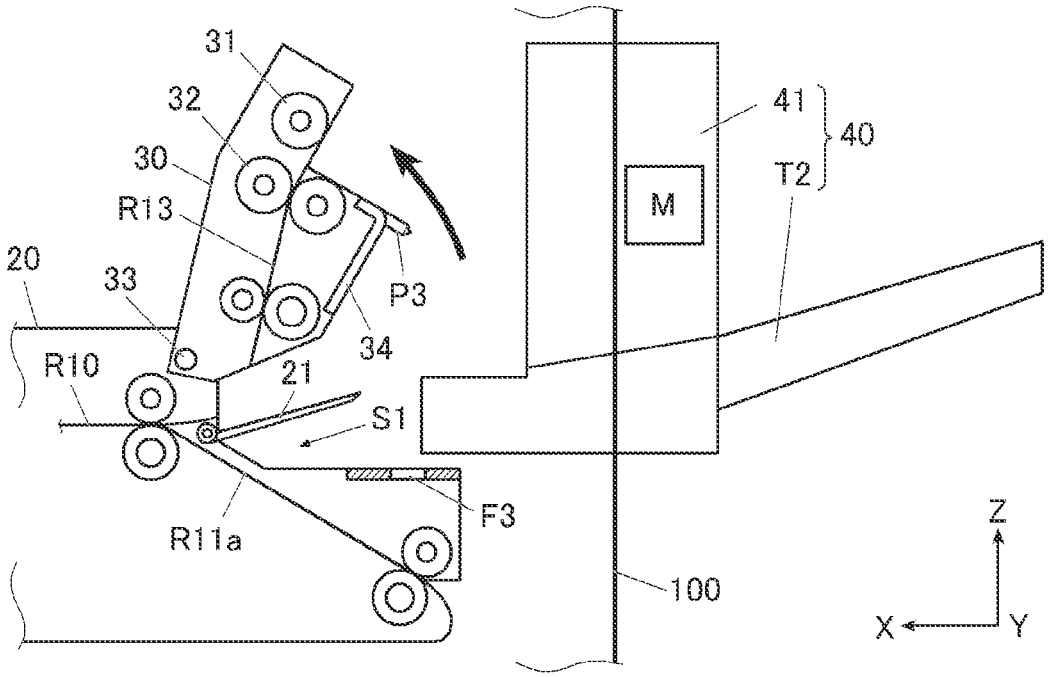
FIG. 6 shows a state in which a guide member is turned to be raised from the state of FIG. 5.

In one or more embodiments, a guide member (or guide plate) 21 is disposed on a side of the conveyance path part R11*a* which is covered by the manual paper feeder 30, and is movably supported so as to expose the conveyance path part R11*a*. Therefore, as shown in FIG. 6, the guide member 21 is also opened so as to move away from the conveyance path part R11*a*. It further facilitates removal of jam paper staying in the conveyance path part R11*a*.

A wide space S1 between the manual paper feeder 30 and the conveyance path part R11*a* shown in FIG. 5 almost disappears in the state shown in FIG. 4. The conveyance table 20 and the manual paper feeder 30 are inserted into the device body 100 in the same state.

Therefore, the space S1 for removing jam paper when the image forming device 1 is stopped for coping with jam is secured without increasing the size of the device during operation (FIGS. 2 and 4). It facilitates coping with a jam in the image forming device 1.

Figure 7:
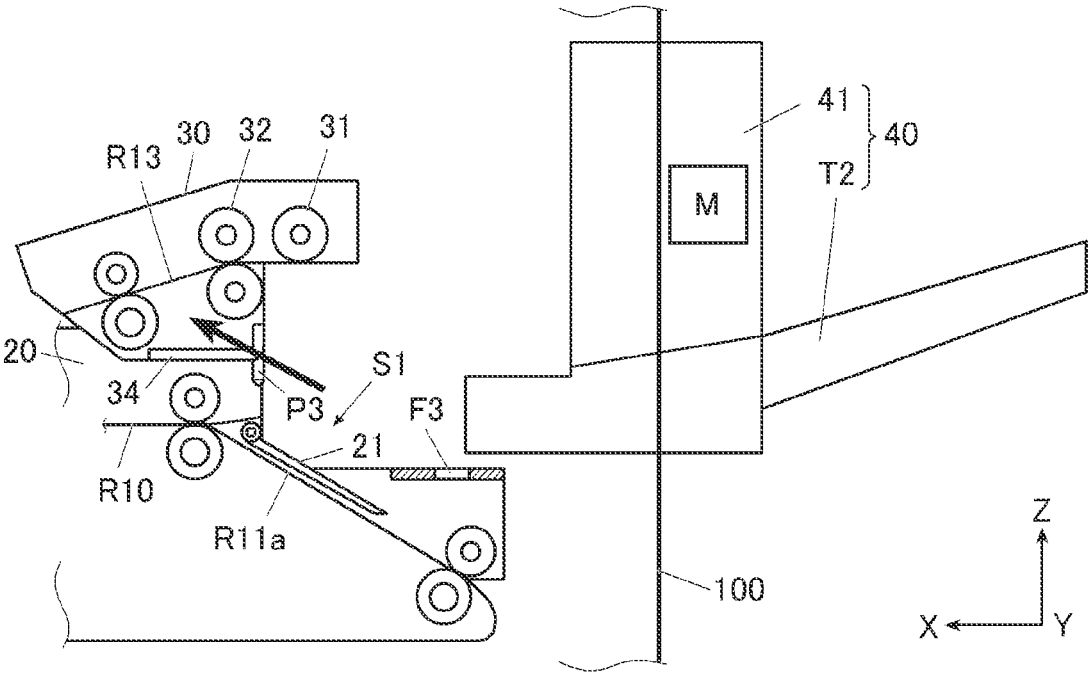
FIG. 7 is a vertical cross-sectional view between the manual feed tray and the conveyance table according to another example of one or more embodiments of the present invention, showing a state in which the manual paper feeder is diagonally raised by linear motion.
Figure 8:
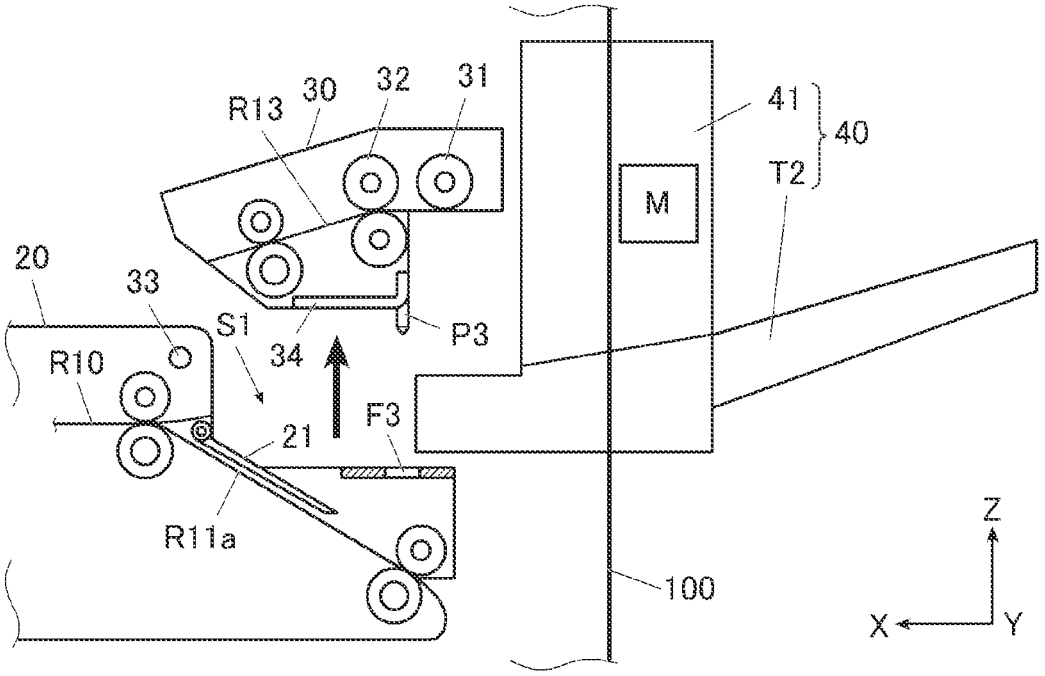
FIG. 8 is a vertical cross-sectional view between the manual feed tray and the conveyance table according to another example of one or more embodiments of the present invention, showing a state in which the manual paper feeder is vertically raised by linear motion.

As long as the space S1 can be secured, the movable support 33 may allow the manual paper feeder 30 to operate linearly at an angle as shown in FIG. 7, or vertically upward as shown in FIG. 8. In this case, a linear motion guide such as a slide rail can be used as the movable support. The mechanism is not limited.

Further details will be explained.

The movable support 33 can perform a self-weight return movement. In the self-weight return movement, a weight of the manual paper feeder 30 returns the manual paper feeder 30 to the state (FIG. 4) where the manual paper feeder 30 together with the conveyance table 20 can be inserted into the device body. As shown in FIG. 5, an operator raises the manual paper feeder 30 to open the manual paper feeder 30. When the operator releases a hand, the manual paper feeder 30 falls due to its own weight and closes as shown in FIG. 4.

If the conveyance table 20 is inserted into the device body 100 as shown in FIG. 2 with the manual paper feeder 30 being opened as shown in FIG. 5, it may cause an accident that the manual paper feeder 30 and the device body 100 collide with each other. If an operator forgets to close the manual paper feeder 30, such an accident may occur. However, since the manual paper feeder 30 falls and closes due to its own weight, the accident is prevented. This function of preventing an accident is simply realized without power.

A range in which the manual paper feeder 30 is operated by the movable support 33 is determined such that the self-weight return movement occurs from any position within the range.

If the center of gravity of the manual paper feeder 30 is on the left of the rotation center of the movable support 33 in FIG. 5, the manual paper feeder 30 falls due to its own weight and closes. It does not return to the state shown in FIG. 4. In that case, the function of preventing an accident does not work.

Therefore, as shown in FIG. 5, the range in which the manual paper feeder 30 is operated by the movable support 33 is regulated so that the center of gravity of the manual paper feeder 30 is not on the left of the rotation center of the movable support 33.

Thus, the movement range of the manual paper feeder 30 is a range between states shown in FIGS. 4 and 5. The center of gravity of the manual paper feeder 30 is always on a side which enables the manual paper feeder 30 to close. As a result, the self-weight return movement occurs from any position. The function of preventing an accident always works. It is safe.

FIGS. 7 to 8 show support mechanisms that open when the manual paper feeder 30 is raised in a linear motion. The movement range of the manual paper feeder 30 is easily set such that the self-weight return movement occurs from any position within the range.

The manual paper feeder 30 has a protective cover 34 that prevents damage on the side facing the conveyance table 20 in the state where the conveyance table 20 is inserted into the device body 100 (FIGS. 2 and 4). The protective cover 34 may be made of resin.

The manual paper feeder 30 may fall in a state where:

the manual paper feeder 30 is opened as shown in FIG. 5; and an operator puts his hand in the space S1 between the manual paper feeder 30 and the conveyance table 20.

Structural parts and mechanical parts which are made of metal or the like are arranged in the manual paper feeder 30. The protective cover 34 covers them. The manual paper feeder 30 is prevented from being damaged. Hands of an operator are protected.

Figure 9:
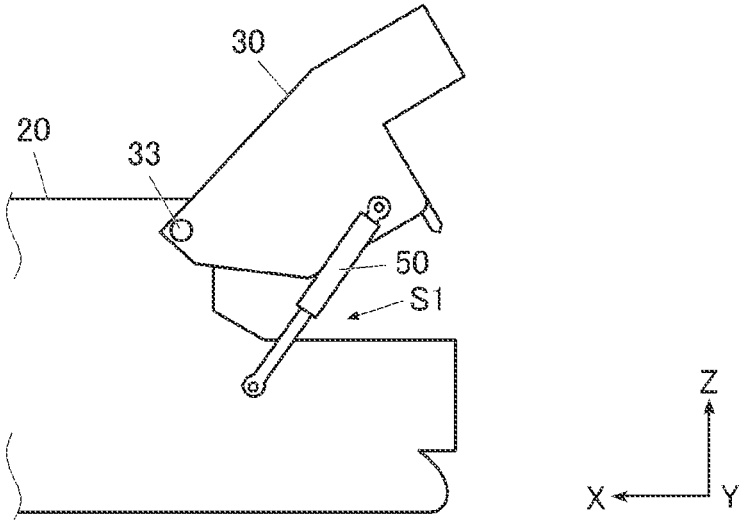
FIG. 9 is a vertical cross-sectional view showing a damper device for the manual paper feeder according to one or more embodiments of the present invention.

As shown in FIG. 9, a damper device 50 that suppresses a speed of the self-weight return movement may be provided. A gas spring can be used as the damper device 50.

It suppresses the speed of the self-weight return movement. The conveyance table 20 and the manual paper feeder 30 are prevented from being damaged. Hands of an operator are protected.

Figure 10:
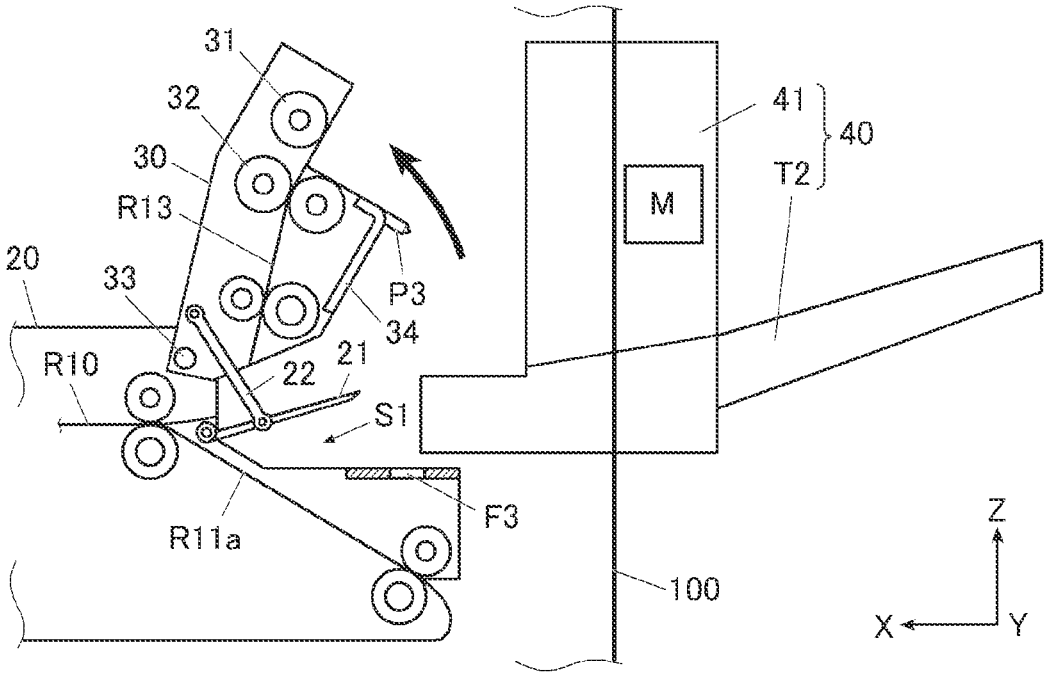
FIG. 10 is a vertical cross-sectional view between the manual feed tray and the conveyance table according to one or more embodiments of the present invention, showing a link mechanism between the manual paper feeder and the guide member.

As shown in FIG. 10, movement of the guide member 21 may be linked to movement of (i.e., the guide member 21 may move in linkage with) the manual paper feeder 30 by the movable support 33. An operator does not need to separately open the guide member 21 in addition to opening the manual paper feeder 30. It increases efficiency in coping with jam.

The linked movement may be realized by a link 22 as shown in FIG. 10. Alternatively, other mechanisms may realize the linked movement.

As shown in FIG. 3, the manual paper feeder 30 includes a handle 35. When an operator lifts the manual paper feeder 30, the handle 35 is grasped. The handle 35 is made of resin or the like. A shape and position of the handle 35 is determined such that the handle 35 can be easily grasped and moved up and down. The handle 35 can guide an operator not to insert a hand that lifts the manual paper feeder 30 under the manual paper feeder 30. Further, providing the handle 35 which can be easily grasped prevents the manual paper feeder 30 from being unexpectedly lowered.

As described above, the manual feed unit 40 including the manual feed tray T2 is provided or disposed in the device body 100. Therefore, the manual feed unit 40 is separated from the manual paper feeder 30 when the conveyance table 20 is pulled out of the device body 100. That is, the manual paper feeder 30 and the manual feed unit 40 are separated when the conveyance table 20 is pulled out, and are connected when the conveyance table 20 is inserted.

In such a structure of separation and connection, accuracy of a position when they are connected is important for smoothly stabilizing paper feed from the manual feed tray T2. Next, a positioning unit for this purpose will be described.

The image forming device 1 includes the positioning unit. The positioning unit determines (or defines) positions of the manual paper feeder 30 and the manual feed unit 40 when the conveyance table 20 is inserted into the device body 100.

As shown in FIGS. 2 to 3, the positioning unit includes:

positioning pins P1, P2 having a shaft extending in a direction Y along which the conveyance table 20 is inserted and pulled; and positioning holes F1, F2 that fit into the positioning pins P1, P2.

The positioning pins P1, P2 are fixed to the manual paper feeder 30. A cross section parallel to the XZ plane is circular. The positioning pin P1, P2 has a tapered portion at a tip for guiding.

The positioning holes F1, F2 are fixed to the manual feed unit 40. A cross section parallel to the XZ plane is circular. The positioning hole F1, F2 has an inner diameter that fits an outer diameter of the positioning pin P1, P2.

The positioning pin P1 fits into the positioning hole F1. The positioning pin P2 fits into the positioning hole F2.

By fitting the positioning pin P1 (P2) into the positioning hole F1 (F2), a position in the X-direction and a position in the Z-direction are determined. The fitting may regulate only a position in the Z direction. This is because the movable support 33 regulates a position in the X direction. To make it possible to release restriction on a position of the positioning pin P1 (P2) in the X direction in the positioning hole F1 (F2), the positioning hole F1 (F2) is formed in a shape of an elongated hole which is long in the X direction. It provides room in the X direction between the positioning hole F1 (F2) and the positioning pin P1 (P2). On the contrary, to make a position of the movable support 33 in the X direction changeable, a position in the X-direction position and a position in the Z-direction are determined by fitting the positioning pin P1 (P2) into the positioning hole F1 (F2) as in one or more embodiments. The pin and the hole may have any shape as long as a positioning function is realized.

Pressing in the Y direction determines a position in the Y direction. The pressing in the Y direction may be performed on a peripheral surface of a base end of the positioning pin P1 (P2), a peripheral surface of the positioning hole F1 (F2), or other surfaces parallel to the XZ surface.

The positioning pin P1 and the positioning hole F1 are provided on a near side. The positioning pin P2 and the positioning hole F2 are provided on a far side. Since positions are determined at both ends in the Y direction, accuracy of position is further improved.

When the conveyance table 20 is inserted into the device body 100, the positioning units (P1, P2, F1, F2) determine positions of the manual paper feeder 30 and the manual feed unit 40. It improves accuracy of position when the manual paper feeder 30 and the manual feed unit 40 are connected. Paper feeding from the manual feed tray T2 is smoothly stabilized.

In a state where the conveyance table 20 can be inserted into the device body 100 as shown in FIGS. 2 to 5, etc., the image forming device 1 includes:

a positioning pin P3 as a positioning unit that determines positions of the conveyance table 20 and the manual paper feeder 30 in the direction Y along which the conveyance table 20 is inserted and pulled; and a positioning hole F3 that fits into the positioning pin P3.

The positioning pin P3 is fixed to the manual paper feeder 30. The positioning hole F3 is fixed to the conveyance table 20.

The positioning hole F3 is formed in a shape of an elongated hole which is long in the X direction as shown in FIGS. 2 to 3. This is to release the positioning pin P3 that moves with turning of the manual paper feeder 30.

An edge of the positioning hole F3 in the Y-direction, that is, an edge parallel to the X direction, regulates a position of the positioning pin P3 in the Y direction.

It improves accuracy of positions of the conveyance table 20 and the manual paper feeder 30 in the Y direction.

As described above, accuracy of controlling sheet positions in the Y direction between the manual feed tray T2 and the conveyance table 20 is improved. It improves accuracy of a position where an image is formed on a sheet.

The present invention is not limited to the above embodiments. Detailed configuration of devices constituting the image forming device and detailed operation of the devices can be modified within the scope of the claims of the present invention.

In the above embodiments, the present invention is applied to a manual paper feeder. The present invention is not limited to this, and may be applied to other paper feeders. It does not matter whether a sheet mount portion of a paper feed source is a manual feed tray or another paper feed tray inside or outside a device.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming device, comprising:

a device body;

a conveyance table that is inserted into and pulled out of the device body and that forms a conveyance path for a sheet;

a sheet mount tray on which the sheet is placed;

a paper feeder that is disposed on the conveyance table and that feeds the sheet from the sheet mount tray to the conveyance path; and a movable support that movably supports the paper feeder on the conveyance table in a state where the conveyance table is pulled out of the device body, wherein the paper feeder covers a predetermined part of the conveyance path in a state where the paper feeder together with the conveyance table are inserted into the device body, the sheet mount tray is disposed in the device body, and separates from the paper feeder when the conveyance table is pulled out of the device body, and the paper feeder movably supported by the movable support moves away from the predetermined part.

2. The image forming device according to claim 1, wherein the paper feeder includes a protective cover on a side facing the conveyance table in the state where the conveyance table is inserted into the device body.

3. The image forming device according to claim 1, wherein the paper feeder rotates around the movable support.

4. The image forming device according to claim 1, wherein the paper feeder linearly moves along the movable support.

5. The image forming device according to claim 1, wherein the paper feeder movably supported by the movable support performs self-weight return movement in which a weight of the paper feeder returns the paper feeder to a state in which the paper feeder together with the conveyance table can be inserted into the device body.

6. The image forming device according to claim 5, wherein the self-weight return movement occurs at any position within a movement range of the paper feeder.

7. The image forming device according to claim 5, further comprising:

a damper device that suppresses a speed of the self-weight return movement.

8. The image forming device according to claim 1, further comprising:

a guide plate that is disposed on a side of the predetermined part covered by the paper feeder and that is movably supported to expose or cover the predetermined part.

9. The image forming device according to claim 8, wherein the guide plate moves in linkage with the paper feeder movably supported by the movable support.

10. The image forming device according to claim 1, wherein the paper feeder includes a handle.

11. The image forming device according to claim 1, further comprising:

a positioning unit that defines positions of the paper feeder and the sheet mount tray when the conveyance table is inserted into the device body.

12. The image forming device according to claim 11, wherein the positioning unit comprises:

a positioning pin that comprises a shaft extending in a direction along which the conveyance table is inserted and pulled; and a positioning hole in which the positioning pin fits.

13. The image forming device according to claim 1, further comprising:

a positioning unit that defines positions of the conveyance table and the paper feeder in a direction along which the conveyance table is inserted and pulled in a state where the conveyance table can be inserted into the device body.

* * * * *